US006153310A

United States Patent [19]

Kato

[11] Patent Number: 6,153,310

[45] Date of Patent: Nov. 28, 2000

[54] INK JET RECORDING SHEET

[75] Inventor: Seiji Kato, Tokyo, Japan

[73] Assignee: Nisshinbo Industries, Inc., Tokyo, Japan

[21] Appl. No.: 09/170,118

[22] Filed: Oct. 13, 1998

[30] Foreign Application Priority Data

Oct. 14, 1997 [JP] Japan ..... 9-294975

[51] Int. Cl.[7] ..... B41M 5/00

[52] U.S. Cl. ..... 428/522; 428/195

[58] Field of Search ..... 428/195, 522

[56] References Cited

U.S. PATENT DOCUMENTS 5,364,702 11/1994 Idei et al. ..... 428/423.1
5,570,120 10/1996 Sukaki et al. ..... 347/105
5,583,553 12/1996 Shirota et al. ..... 347/100

FOREIGN PATENT DOCUMENTS 60-189480 9/1985 Japan .
61-57379 3/1986 Japan .

*Primary Examiner*—Bruce H. Hess
*Attorney, Agent, or Firm*—Rogers & Killeen

[57] ABSTRACT

An ink jet recording sheet is disclosed which has excellent ink retention properties, color development properties, weather resistance and water resistance, and which is substantially free from curling even if it has its only one side provided with an ink receiving layer. In particular, the present invention relates to an ink jet recording sheet which is extremely suited for use in poster applications. The ink jet recording sheet comprises: a substrate having its at least one side provided with an ink receiving layer; the ink receiving layer containing a nonionic surfactant and a binder resin, solid content of the nonionic surfactant being in a range of 11% to 20% by weight of total solid content of the ink receiving layer, the binder resin containing a silanol group-modified polyvinyl alcohol as a component thereof in an amount of 70% by weight or more of solid content of the binder resin.

5 Claims, No Drawings

INK JET RECORDING SHEET

BACKGROUND OF THE INVENTION

Field of the Invention

The present invention relates to an ink jet recording sheet which has excellent ink retention properties, color development properties, weather resistance and water resistance, and which is substantially free from curling even if it has its only one side provided with an ink receiving layer. In particular, the present invention relates to an ink jet recording sheet which is extremely suited for use in poster applications.

2. Description of the Prior Art

Hitherto known recording methods include a thermal mass transfer recording method, a thermal sublimable dye transfer recording method, an electrophotographic recording method, and an ink jet recording method. Of these, the ink jet recording method has increasingly employed in recent years in view of noiselessness in recording operation, high speed operation, suitability for recording a large graphic, economically desirable running cost therefor. Recently, increasing requests have been made to prepare large-sized posters, signs or the like in a lot having a small size in full color in a short appointed period of time. In addition to the above-mentioned desired properties, the ink jet recording method has an advantage that it is readily adaptable for recording in multicolor. Accordingly, the ink jet recording method is suited to meet such requests.

The ink jet recording method fully exhibits its excellent effect by means of a combination of an ink jet printer with a recording sheet suitable for the printer. However, as improvements have been made in performance of an ink jet printer as the fruits of technological progress, ink jet recording sheets have been desired which have excellent properties commensurate with the improvements.

In particular, an ink jet recording sheet has been desired which exhibits a color development density that is high enough for use in a large-sized poster or the like, and which enables formation of a clear graphic substantially free from graphic irregularity and color irregularity, and which is less susceptible to deterioration of a graphic formed even if exposed to sunlight, UV-containing light or the like, and which has excellent water resistance.

In the existing circumstances, however, an ink jet recording sheet has not yet been provided which has excellent properties as described above. Only recording sheets which are described in the following and such like have been proposed.

For example, as a conventional ink jet recording sheet, an ink jet recording sheet is proposed in Japanese Unexamined Patent Publication No. 189480/1985 which comprises a substrate, and an ink receiving layer provided thereon and including a filler (such as synthetic silica, magnesium carbonate, calcium silicate or the like) and a polymeric binder.

In the ink jet recording sheet according to the proposal, however, a colorant is retained only by adsorption thereof on the filler. Accordingly, the recording sheet has a problem that retention of the colorant in the ink receiving layer is poor and, in particular, the colorant is likely to bleed when the recording sheet is wetted.

In Japanese Unexamined Patent Publication No. 57379/1986, an ink jet recording sheet is proposed which is provided with an ink receiving layer containing therein a cationic resin.

The ink jet recording sheet according to the latter proposal has colorant retaining mechanism different from that of the ink jet recording sheet according to the former proposal. In the ink jet recording sheet according to the latter proposal, cationic groups in the ink receiving layer react with anionic groups of a colorant of an ink, such as $SO_3^{--}$, $COO^-$ or the like to form water-insoluble salt, Accordingly, retention of the colorant is improved, leading to improved water resistance of the colorant. On the other hand, however, the recording sheet according to the latter proposal has a problem that its weather resistance is poor.

SUMMARY OF THE INVENTION

It is, therefore, an object of the present invention to provide an ink jet recording sheet which is capable of solving the above-described problems in the conventional ink jet recording sheets, i.e., an ink jet recording sheet which has excellent ink retention properties, color development properties, weather resistance and water resistance, and which is substantially free from curling even if it has its only one side provided with an ink receiving layer. In particular, the present invention relates to an ink jet recording sheet which is extremely suited for use in poster applications.

The present invention has been made with a view to attaining the above object. According to the present invention, there is provided an ink jet recording sheet comprising:

a substrate having its at least one side provided with an ink receiving layer;

the ink receiving layer containing a nonionic surfactant and a binder resin, solid content of the nonionic surfactant being in a range of 11% to 20% by weight of total solid content of the ink receiving layer, the binder resin containing a silanol group-modified polyvinyl alcohol as a component thereof in an amount of 70% by weight or more of solid content of the binder resin.

The present inventors have made intensive and extensive researches with a view to developing a novel ink jet recording sheet on the basis of the following expectative concept. In a conventional ink jet recording sheet provided with an ink receiving layer containing a cationic resin in an amount of 2% by weight or more of solid content of the ink receiving layer, the cationic resin reacts with an anionic colorant of an ink to form a water-insoluble salt, thereby contributing to good colorant retention. However, molecules of the colorant become susceptible to decomposition by exposure to ultraviolet radiation or the like to cause lowering of color development density, leading to deterioration of a graphic formed. In view of this, if colorant retention can be improved with a cationic resin contained an ink receiving layer in a minimized amount (less than 2% by weight, for example, about 0.5% to about 1% by weight ) or even with no cationic resin at all, the problem is expected to be prevented from occurring.

As a result of the intensive and extensive researches, the present invention has been completed.

DESCRIPTION OF THE PREFERRED EMBODIMENTS

In the following, description will be given on the structure of the ink jet recording sheet according to the present invention.

The present invention is directed to an ink jet recording sheet which comprises a substrate provided with an ink receiving layer on one side or each side thereof. Between the substrate and the ink receiving layer, an undercoat layer may appropriately be provided.

As the substrate used in the present invention, there may be used a sheet of pulp-based paper such as woodfree paper, Kent paper or coated paper, or a film or sheet of a polypropylene, a polyethylene terephthalate, a polyvinyl chloride, a polystyrene, a foam thereof or a plastic thereof containing an inorganic pigment such as calcium carbonate.

The ink receiving layer of the ink jet recording sheet according to the present invention, which is provided on at least one side of the substrate as described above, contains a binder resin and a nonionic surfactant. Further, a filler is incorporated therein in an appropriate amount. The ink receiving layer may be provided on each side of the substrate.

The binder resin contained in the ink receiving layer comprises a silanol group-modified polyvinyl alcohol as a component thereof in an amount of 70% or more, preferably 80% or more, based on the weight of solid content of the binder resin. Such a high content of the silanol group-modified polyvinyl alcohol is employed for the following reason. A usual binder resin to which no silanol group-modified polyvinyl alcohol is added combines 1 to 2 parts by weight of a filler relative to 1 part by weight of the solid content of the binder resin. On the other hand, the silanol group-modified polyvinyl alcohol in the present invention provides such an effect that its silanol groups chemically combine with an inorganic filler to thereby enable the binder resin of the present invention to combine 5 to 7 parts by weight of the filler relative to 1 part by weight of the solid content of the binder resin. This leads not only to an effect of improving in ink absorption properties, but also to an effect of improving retention of a colorant to contribute to improved water resistance of the colorant when the silanol group-modified polyvinyl alcohol is used in combination with a predetermined amount of the nonionic surfactant as another feature of the present invention.

As the filler contained in the ink receiving layer, an inorganic filler such as synthetic silica, clay, talc, diatomaceous earth, calcium carbonate, calcined kaolin, titanium oxide or zinc oxide may preferably be used.

The nonionic surfactant contained in the ink receiving layer is roughly classified into a polyethylene glycol type and a polyhydric alcohol type. Of these, the polyethylene glycol type nonionic surfactant is particularly effective. Examples of the nonionic surfactant include an adduct of a higher alcohol with ethylene oxide, an adduct of ahigher alkylamine with ethylene oxide, an adduct of an alkylphenol with ethylene oxide, an adduct of a fatty acid with ethylene oxide, an adduct of a fatty acid ester of a polyhydric alcohol with ethylene oxide, an adduct of a fatty acid amide with ethylene oxide, an adduct of fats and oils with ethylene oxide, and an adduct of a polypropylene glycol with ethylene oxide. The nonionic surfactant is contained in the ink receiving layer in an amount of 11% to 20%, preferably 14% to 18%, based on the weight of total solid content of the ink receiving layer, thereby attaining excellent effect in color development density.

Further, according to the present invention, it is possible to improve water resistance of a colorant with incorporation of a cationic substance such as a cationic resin in the ink receiving layer in an extremely small amount as compared with that in a conventional ink receiving layer or even with no incorporation of a cationic substance in the ink receiving layer at all. Accordingly, extremely improved weather resistance of a graphic is attained as described above.

As a method for applying the ink receiving layer, various known methods such as reverse-roll coating, air-knife coating, gravure coating and blade coating may be employed.

The ink jet recording sheet of the present invention is constructed as described above, and it is substantially free from curling even if its substrate is provided with an ink receiving layer on only one side thereof. The reason for this is not clearly understood at present. It is, however, believed that the effect is obtained by virtue of the components of the ink receiving layer and the specific proportions thereof.

The present invention is constructed as described above, and the ink jet recording sheet of the present invention has superior ink retention properties, color development properties, water resistance and weather resistance as compared to conventional recording sheets, and it is substantially free from curling even if its substrate is provided with an ink receiving layer on only one side thereof.

Since the ink jet recording sheet according to the present invention has the above-described characteristics, it is less susceptible to deterioration of a graphic formed even if exposed to sunlight or UV-containing light. Accordingly, it is extremely suited for use in a poster, a sign, and a display sheet for various signboards such as a billboard, a bulletin board and the like.

In the next place, description will be given on Examples of the ink jet recording sheet according to the present invention.

EXAMPLE 1

As a substrate, a calcium carbonate-incorporated polypropylene film (produced by OJI-YUKA SYNTHETIC PAPER CO., LTD., Yupo FPG-80) was used. Onto one side thereof, an acrylic binder was applied to form a layer in a dry thickness of 1 $\mu$m as an undercoat layer.

Then, to 38 parts by weight of a silanol group-modified polyvinyl alcohol (produced by KURARAY CO. ,LTD., R-1130) as a single component of a binder resin, there were added 38 parts by weight of a polyethylene glycol type surfactant (produced by SAN NOPCO LTD., SN WET 366, solid content: 70%), 6 parts by weight of a cationic resin (produced by SHOWA HIGHPOIYMER CO., LTD., POLY-FIX 301, solid content: 30%), and 100 parts by weight of a synthetic amorphous silica (oil absorptiveness: 230 ml/100 g, average particle diameter: 13.0 $\mu$m) as a filler. The mixture was sufficiently stirred and then dispersed by a sand grinder to prepare a coating fluid. The coating fluid was applied onto the undercoat layer on the substrate by means of a reverse-roll coater in a dry thickness of 55 $\mu$m to obtain an ink jet recording sheet according to the present invention.

EXAMPLE 2

An ink jet recording sheet was obtained in substantially the same manner as in Example 1 except that as components of a binder resin, 34 parts by weight of a silanol group-modified polyvinyl alcohol (produced by KURARAY CO., LTD., R-1130) and 4 parts by weight of a polyvinyl alcohol (produced by KURARAY CO., LTD., PVA 105) were used, in other words, the silanol group-modified polyvinyl alcohol accounted for 89.5% of the solid content of the binder resin components, and that a polyethylene glycol type surfactant (produced by SAN NOPCO LTD., SN WET 366, solid content: 70%) was used in an amount of 25 parts by weight, in other words, the polyethylene glycol type surfactant accounted for 11.1% of the total solid content.

EXAMPLE 3

An ink jet recording sheet was obtained in substantially the same manner as in Example 1 except that as components of a binder resin, 30 parts by weight of a silanol group-modified polyvinyl alcohol (produced by KURARAY CO., LTD., R-1130) and 8 parts by weight of a polyvinyl alcohol (produced by KURARAY CO., LTD., PVA 105) were used, in other words, the silanol group-modified polyvinyl alcohol accounted for 78.9% of the solid content of the binder resin components, and that a polyethylene glycol type surfactant (produced by SAN NOPCO LED., SN WET 366, solid content: 70%) was used in an amount of 49 parts by weight, in other words, the polyethylene glycol type surfactant accounted for 19.7% of the total solid content.

EXAMPLE 4

An ink jet recording sheet was obtained in substantially the same manner as in Example 1 except that no cationic resin (produced by SHOWA HIGHPOLYMER CO. , LTD. , POLYFIX 301, solid content: 30%) was added.

COMPARATIVE EXAMPLE 1

An ink jet recording sheet was obtained in substantially the same manner as in Example 1 except that as components of a binder resin, 23 parts by weight of a silanol group-modified polyvinyl alcohol (produced by KURARAY CO., LTD., R-1130) and 15 parts by weight of a polyvinyl alcohol (produced by KURARAY CO., LTD., PVA 105) were used, in other words, the silanol group-modified polyvinyl alcohol accounted for 60.5% of the solid content of the binder resin components.

COMPARATIVE EXAMPLE 2

An ink jet recording sheet was obtained in substantially the same manner as in Example 1 except that as components of a binder resin, 23 parts by weight of a silanol group-modified polyvinyl alcohol (produced by KURARAY CO., LTD., R-1130) and 15 parts by weight of a polyvinyl alcohol (produced by KURARAY CO., LTD., PVA 105) were used, in other words, the silanol group-modified polyvinyl alcohol accounted for 60.5% of the solid content of the binder resin components, and that 85 parts by weight of a synthetic amorphous silica (oil absorptiveness: 230ml/100 g, average particle diameter: 13.0 m) was used as a filler.

COMPARATIVE EXAMPLE 3

An ink jet recording sheet was obtained in substantially the same manner as in Example 1 except that 20 parts by weight of a polyethylene glycol type surfactant (produced by SAN NOPCO LTD., SN WET 366, solid content: 70%) was used.

COMPARATIVE EXAMPLE 4

An ink jet recording sheet was obtained in substantially the same manner as in Example 1 except that 54 parts by weight of a polyethylene glycol type surfactant (produced by SAN NOPCO LTD., SN WET 366, solid content: 70%) was used.

With respect to each of the thus obtained ink jet recording sheets, graphic density, ink bleeding, water resistance and weather resistance were evaluated according to the following evaluation methods.

[Evaluation Methods]

(1) Graphic Density

Each sample was printed with a graphic using a water-base ink (magenta) by a commercially available ink jet printer, and density of the graphic was measured by a Macbeth RD-918 reflection densitometer.

(2) Ink Bleeding

Each sample was subjected to overprinting with a water-base ink (magenta) and a water-base ink (yellow) by the printer, and ink bleeding was visually examined.

(3) Water Resistance

Each sample printed with a graphic was allowed to stand at room temperature for 24 hours and then soaked in water at 25° C. for 3 hours. Then, the sample was taken out and air-dried. Prior to and posterior to the soaking in water, density of the graphic was measured to calculate a remaining ratio.

Remaining Ratio (%)=(graphic density posterior to the soaking in water/graphic density prior to the soaking in water)×100

(4) Weather Resistance

Each sample printed with a graphic was subjected to exposure by means of a xenon fadeometer for 16 hours. Prior to and posterior to the exposure, density of the graphic was measured to calculate a remaining ratio.

Remaining Ratio (%)=(graphic density posterior to the exposure/graphic density prior to the exposure)×100

The results of the evaluations are shown in Table 1.

TABLE 1

| | graphic density (Note 1) | ink bleeding (Note 2) | water resistance (Note 3) | weather resistance (Note 4) |
|---|---|---|---|---|
| Ex. 1 | ⊙ (1.53) | ⊙ | ⊙ (92%) | ⊙ (88%) |
| Ex. 2 | ○ (1.49) | ⊙ | ⊙ (92%) | ⊙ (89%) |
| Ex. 3 | ⊙ (1.55) | ⊙ | ○ (89%) | ⊙ (88%) |
| Ex. 4 | ⊙ (1.52) | ⊙ | ⊙ (90%) | ⊙ (91%) |
| Comp. Ex. 1 | ○ (1.46) | ⊙ | — (Note 5) | ⊙ (87%) |
| Comp. Ex. 2 | x (1.39) | ○ | x (83%) | ⊙ (85%) |
| Comp. Ex. 3 | x (1.42) | ⊙ | ○ (89%) | ⊙ (87%) |
| Comp. Ex. 4 | ⊙ (1.57) | ○ | ○ (88%) | ○ (84%) |

Note 1: Each numerical value in ( ) represents graphic density. Graphic density of: 1.5 or more is classified as ⊙, less than 1.5 to 1.45 as ○, and less than 1.45 as ×.

Note 2: No ink bleeding is classified as ⊙, slight ink bleeding as ○, and considerable ink bleeding as ×.

Note 3: Each numerical value in ( ) represents remaining ratio (%) of graphic density. Remaining ratio of: 90% or more is classified as ©, less than 90% to 85% as 0, and less than 85% as ×.

Note 4: Each numerical value in ( ) represents remaining ratio (%) of graphic density. Remaining ratio of: 85% or more is classified as ⊙, less than 85% to 80% as ○, and less than 80% as ×.

Note 5: Peeling of surface layer was caused, and thus graphic density could not be measured posterior to the soaking in water.

Each of the ink jet recording sheets in Examples 1 to 4 showed satisfactory results, i.e., a graphic density of 1.45, a remaining ratio of graphic density of 85% or more posterior to the water resistance test, and a remaining ratio of graphic density of 85% or more posterior to the weather resistance test.

In Comparative Example 1, the amount of the silanol group-modified polyvinyl alcohol was as low as 60.5% by weight of solid content of the components of the binder resin. Accordingly, the filler contained in the same amount as in each of Examples 1 to 4 was too much for the binder resin to sufficiently combine, thereby leading to poor filler binding properties. Owing to this, peeling of the surface layer of the sample was caused by the soaking in water. Therefore, the recording sheet in Comparative Example 1 cannot be put to practical use.

In Comparative Example 2, although the silanol group-modified polyvinyl alcohol was used in the same amount as in Comparative Example 1, i.e., the amount of 60.5% by weight of the solid content of the components of the binder resin, the filler was used in the smaller amount as compared with Comparative Example 1, i.e., the amount of 85 parts by weight. Accordingly, no peeling of the surface layer of the sample was caused by the soaking in water. Owing to the small amount of the filler, however, the recording sheet were poor in color development density and in water resistance of the ink.

In Comparative Example 3, the polyethylene glycol type surfactant was used in the amount as small as 9.1% by weight of the total slid content. This led to the poor color development density. In Comparative Example 4, the polyethylene glycol type surfactant was used in the amount as large as 21.3% by weight of the total solid content. Consequently, ink bleeding was caused. In the light of these, it is evidently effective to use the polyethylene glycol type surfactant in an amount of 11% to 20% by weight of the total solid content.

What is claimed is:

1. An ink jet recording sheet comprising:

a substrate having at least one side provided with an ink receiving layer;

said ink receiving layer containing a nonionic surfactant and a binder resin, solid content of said nonionic surfactant being in a range of 11% to 20% by weight of total solid content of said ink receiving layer, said binder resin containing a silanol group-modified polyvinyl alcohol as a component thereof in an amount of 70% by weight or more of solid content of said binder resin.

2. The ink jet recording sheet according to claim 1, wherein said nonionic surfactant is a polyethylene glycol type surfactant.

3. The ink jet recording sheet according to claim 1, wherein said ink receiving layer contains a cationic resin as a component thereof in an amount of 2% by weight or less of solid content of the ink receiving layer.

4. An ink jet recording sheet comprising:

a substrate having at least one side provided with an ink receiving layer;

said ink receiving layer containing a nonionic surfactant and a binder resin, solid content of said nonionic surfactant being a polyethylene glycol type surfactant in the range of 1% to 20% by weight of total solid content of said ink receiving layer.

5. The ink jet recording sheet according to claim 4, wherein said ink receiving layer contains a cationic resin as a component thereof in an amount of 2% by weight or less of solid content of the ink receiving layer.

* * * * *